United States Patent [19]

Artiano

[11] Patent Number: 4,616,785

[45] Date of Patent: Oct. 14, 1986

[54] METHOD OF AND APPARATUS FOR DEBARKING WOOD CHIPS

[75] Inventor: Adrian Artiano, Oregon City, Oreg.

[73] Assignee: Beloit Corporation, Beloit, Wis.

[21] Appl. No.: 403,487

[22] Filed: Jul. 30, 1982

[51] Int. Cl.[4] ..... B02C 19/12

[52] U.S. Cl. ..... 241/26; 241/284

[58] Field of Search ..... 144/176 R; 241/81, 28, 241/14, 24, 80, 97, 26, 284, 16, 172, 46.17, 30, 186 A, 260, 260.1, 154, 152 R

[56] References Cited

U.S. PATENT DOCUMENTS

| | | | |
|---|---|---|---|
| 1,057,747 | 4/1913 | Leetham | 241/284 |
| 1,956,293 | 4/1934 | Klein et al. | 241/16 X |
| 2,578,180 | 12/1951 | Edwards | 241/284 |
| 2,835,292 | 5/1958 | Berliner | 241/284 X |
| 3,070,318 | 12/1962 | Blanchard | 241/14 |
| 3,337,139 | 8/1967 | Lloyd et al. | 241/20 |
| 3,371,598 | 3/1968 | Waplan | 100/166 |
| 3,826,433 | 7/1974 | Erickson et al. | 241/14 |
| 3,845,905 | 11/1974 | Haslberger | 241/26 |
| 4,332,353 | 6/1982 | Lario et al. | 241/14 |
| 4,347,986 | 9/1982 | Haddon | 241/284 X |

FOREIGN PATENT DOCUMENTS

| | | | |
|---|---|---|---|
| 10301 | 8/1921 | Sweden | 241/284 |

*Primary Examiner*—Mark Rosenbaum

*Attorney, Agent, or Firm*—Hill, Van Santen, Steadman & Simpson

[57] ABSTRACT

Wood chips are debarked by compacting them in a mass, and agitating the compacted mass. In the compacted mass the chips are caused to rub against one another so that the bark is removed from the chips by rubbing friction of chip against chip. Frictional pressure on the removed bark finely comminutes the bark for easy separation from the debarked chips. The compacting and agitating of the chip mass is effected by a rotor device in a debarking drum chamber.

21 Claims, 11 Drawing Figures

RECHIPPER
A
B
II
II

METHOD OF AND APPARATUS FOR DEBARKING WOOD CHIPS

This invention relates to the preparation of wood chips for paper making, and is more particularly concerned with solving the problem of debarking the chips as derived from whole tree chippers.

Although the advantages of increased yield per acre can result from utilizing whole trees in the chipping process, and thus freedom from trash residue and reduction in the wood biomass left behind after conventional logging, there has been a lack of an economical debarking process which will yield clean chips for pulping. It is a principal aim of the present invention to meet that need.

Various and sundry processes and apparatus have been heretofore proposed for removing the bark from wood chips. By way of example, the following prior U.S. patents are referred to as follows:

U.S. Pat. No. 3,070,318, discloses use of a roll mill by which the bark is separated from the chips by crushing between rotating rolls. This process detrimentally damages the chips and is wasteful of the white wood.

U.S. Pat. No. 3,337,139, discloses a combination of roll mill and sink/float separation and combines the disadvantages of the roll mill crushing of the chips and saturating the chips so that when the very wet chips are mixed with standard chips in a pulp mill operation, the result is unsatisfactory pulp uniformity.

U.S. Pat. No. 3,371,598, discloses a more sophisticated roll press which even more severely damages the chips.

U.S. Pat. No. 3,826,433, discloses a combination of steaming the chips, mechanically compressing or crushing the chips between rolls and then abrading the chips between abrading belts. Chip damage is excessive.

U.S. Pat. No. 4,332,353, discloses subjecting the chips to a ball mill grinder to abrade and crush the chips to remove the bark. Chip damage is inevitable.

In general, it may be observed that the prior processes and apparatus exemplified by the foregoing listed patents are fairly complex and costly and of poor yield of white wood for satisfactory pulp uniformity.

By the present invention, efficient debarking is attained without crushing or soaking the chips and without crushing or otherwise damaging the chips, while attaining excellent bark removal.

To this end, the present invention provides a new and improved method of debarking wood chips, comprising compacting a mass of substantially unbarked wood chips, agitating the compacted mass and causing the chips to rub against one another in the compacted mass, and thereby removing the bark from the chips by rubbing friction of chip against chip as agitated in the compacted mass.

The present invention also provides apparatus for debarking wood chips, comprising means for compacting a mass of substantially unbarked wood chips, and for agitating the compacted mass and causing the chips to rub against one another in the compacted mass, so that the bark is removed from the chips by rubbing friction of chip against chip as agitated in the compacted mass.

Other objects, features and advantages of the invention will be readily apparent from the following description of representative embodiments thereof, taken in conjunction with the accompanying drawings, although variations and modifications may be effected without departing from the spirit and scope of the novel concepts embodied in the disclosure, and in which.

Figures 1, 5:
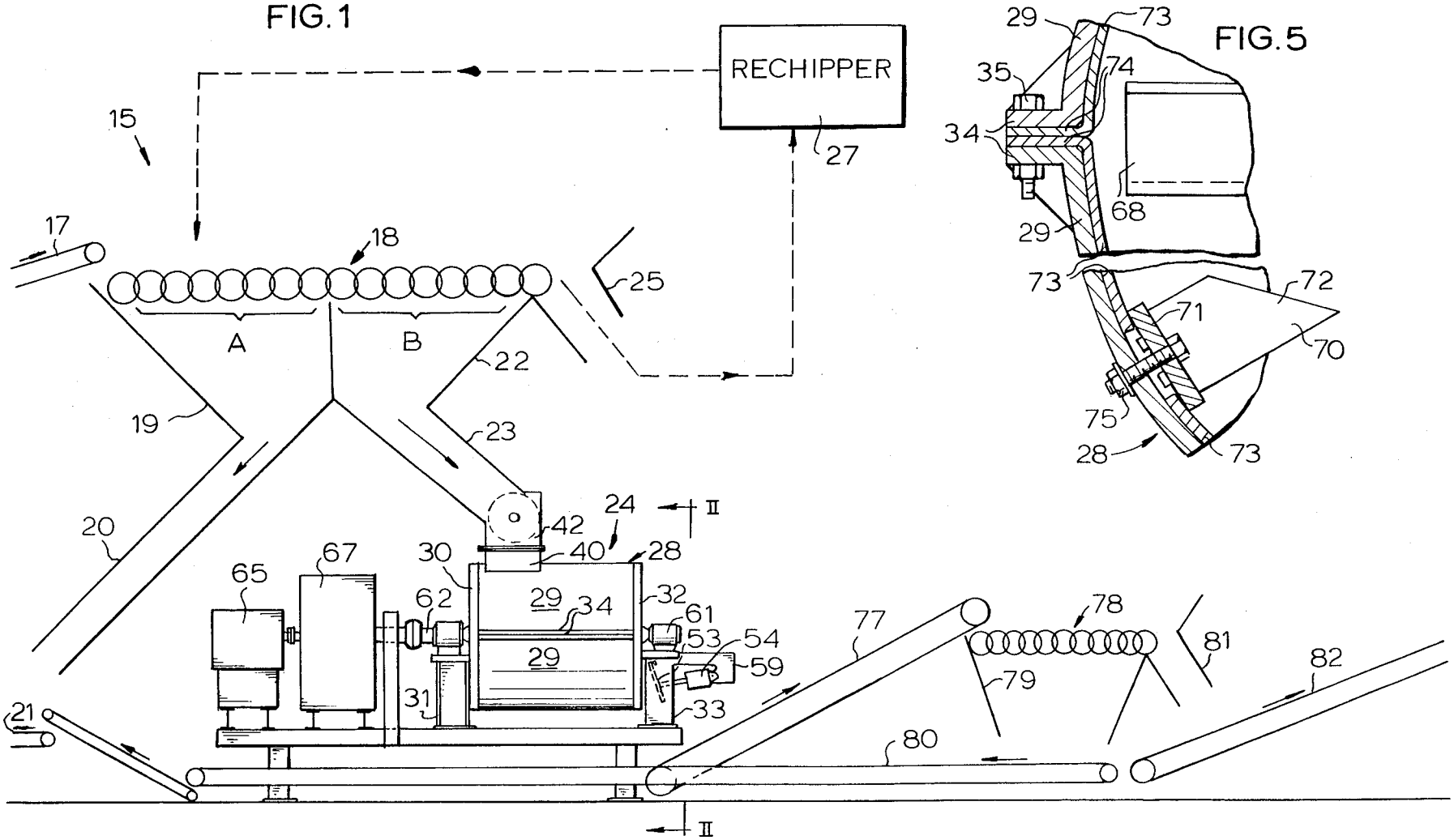
FIG. 1 is a schematic illustration of apparatus embodying the invention.
FIG. 5 is an enlarged fragmentary detail view taken within the balloon IV in FIG. 4.
Figure 2:
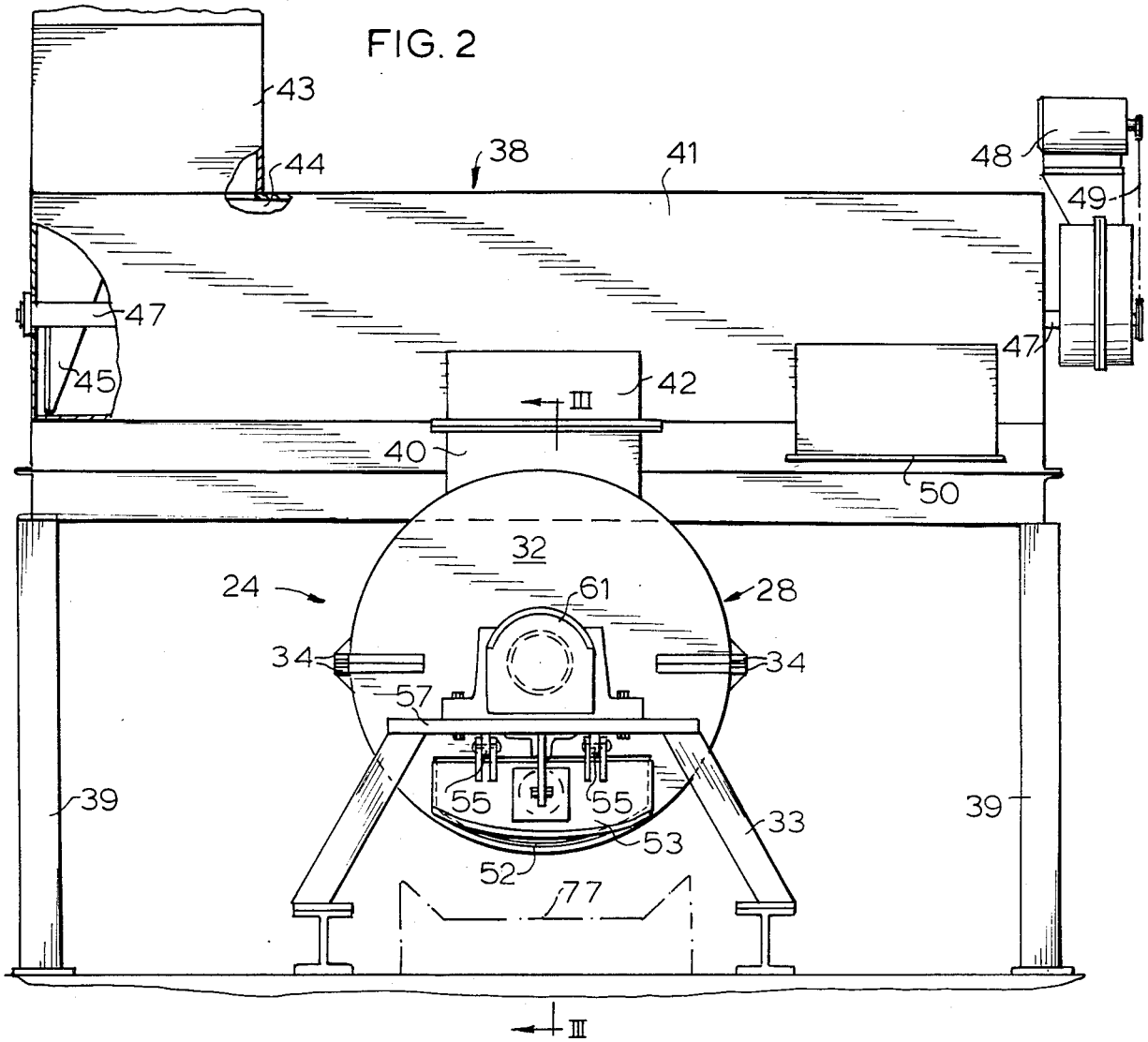
FIG. 2 is an enlarged end elevational view taken substantially along the line II—II of FIG. 1.
Figure 4:
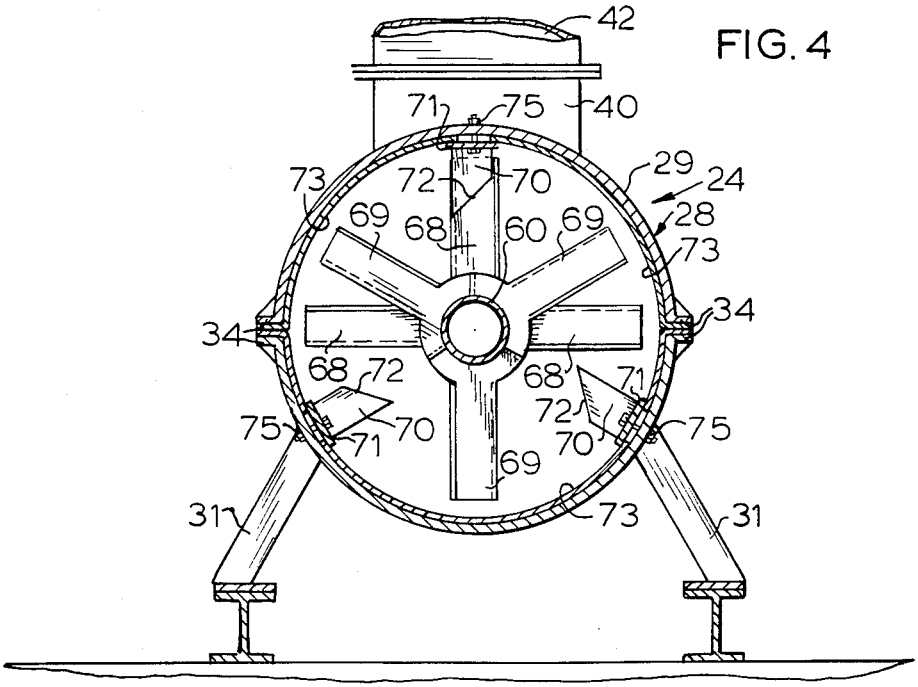
FIG. 4 is a smaller scale vertical sectional detail view taken substantially along the line IV—IV of FIG. 3.

Referring to FIG. 1, apparatus 15 for debarking wood chips in accordance with the present invention, comprises means including an endless infeed conveyor 17 for supplying bark carrying wood chips to means including a disk screen 18 for classifying the supplied wood chips to remove fines and oversize chips from chips of desirable size. It will be understood that the infeed conveyor 17 leads from any suitable chip source, such as a supply bin or a chipper. The debarker 15 is especially suitable for debarking whole tree chips, that is not only chips made from the tree trunk, but also from all of the slash which has heretofore frequently been left on the forest floor.

For classification purposes, the disk screen 18 has a plurality of sections, herein two, wherein the first section identified as A receives the chips from the conveyor 17 and is of sufficient length and of a screen mesh rating for screening out fines, which includes dirt, sand, comminuted bark and any chip particles which are undersize for the intended purpose. The screened out fines drop into a hopper 19 and are conducted as by means of a chute 20 to a take-away conveyor 21 which may lead to a storage bin or other place where the fines may be acummulated as combustible fuel material or for any other desired purpose. Beyond the section A, the chips loaded onto the classifier 18 run onto a chip screening section B which separates dessirable size chips from oversize chips. Desirable size chips drop through the screen section B and into a hopper 22 from which the chips are led as by means of a chute 23 to a debarker assembly 24. Oversized chips are conducted from the screen section B by means including a chute 25 to a rechipper 27, from which the rechipped chips are conveyed back to the screen section A to repeat the classifying process.

Of particular significance is the method of and means for debarking provided by the debarker assembly 24. Having references to FIGS. 1–4, the assembly 24 comprises a horizontally oriented stationary cylindrical vessel or drum 28 having an elongate cylindrical housing wall shell or casing 29 closed at one end by a closure wall 30 fixedly secured to a supporting frame 31 and closed at the opposite end by a closure wall 32 fixedly secured to a supporting frame 33. In a preferred construction, the drum shell 29 is formed from separable semicircular half-shell sections which are provided with longitudinally extending complementary radially outwardly projecting clamping flanges 34 along diametrically opposite sides, and secured together as by means of bolts 35 (FIG. 5).

Although the debarking assembly 24 may be operated as a batch debarker, it is preferably operated on a continuous basis. To this end, means are provided for steadily charging into a debarking chamber 37 within the drum 28 classified chips supplied through the chute 23. For this purpose, a feeder assembly 38 is mounted on supporting frame means 39 over one end portion of the drum 28 and in particular adjacent to the end wall 30, for delivering chips through delivery port means 40 into that end of the chamber 37. In a desirable construction, the feeder 38 comprises a horizontally elongate feeder tube 41 having intermediately thereof downwardly opening port means 42 coaxially aligned with and attached to the delivery port means 40 of the drum 28. At one end, the feeder tube 41 has upwardly opening intake port means 43 with which the lower end of the chute 23 communicates for delivery of classified wood chips into a feeder chamber 44 within the tube 41.

To assure positive continuous feed loading of classified chips into the debarker drum 28, feeding impeller means are provided in the feeder tube 41, comprising a helical feed screw 45 mounted on a shaft 47 journalled at its opposite ends in suitable bearings on end walls closing the ends of the tube 41. Means for rotatably driving the feed screw 45 comprise a motor 48 suitably connected as by means of an endless drive 49 with one end of the shaft 47. Through this arrangement, assurance is provided for full capacity load in the debarker drum 28 for the intended purpose. Overload relief vent means 50 are provided adjacent to the end of the feeder tube 41 remote from the intake 43 for safety dumping of the impelled chip load, if necessary.

Within the debarker drum 28, means are provided for compacting the mass of bark carrying wood chips fed into the drum, and for agitating the compacted mass and causing the chips to rub against one another in the compacted mass, so that the bark is removed from the chips by rubbing friction of chip against chip as agitated in the compacted mass. For this purpose (FIGS. 3–5), a chip compacting and agitating rotor 51 is mounted within the drum chamber 37 for forcing the mass of chips fed into the chamber 37 toward the end wall 32 where the debarked chips and bark separated therefrom are discharged through a limited area horizontally elongated metering discharge port 52 in the lower part of the end wall 32 and from which discharge is controlled by means of a metering flap valve plate 53 (FIGS. 2 and 3) adapted to be accurately controlled by an actuator such as a hydraulic or pneumatic cylinder 54. In order to have the valve 53 serve not only as a discharge pressure controlling device, but also as a downward discharge deflector, the valve plate is hingedly mounted as by means of hinges 55 to a crossmember 57 of the supporting frame means 33. As best seen in FIG. 1, the valve control cylinder 54 is mounted to the crossbeam member 57 by means of a bracket 59. Through this arrangement, the valve member 53 is adapted to be adjusted swingably into and maintained in the discharge pressure controlling position best suited for attainment of best results in any given operating interval.

In a preferred construction, the rotor 51 comprises a sturdy shaft 60 which extends at its opposite ends coaxially through the opposite end walls 30 and 32. At its end which projects rotatably through the end wall 32, the shaft 60 is journalled in bearing means 61 mounted on the frame crossbeam 51. At its end which extends rotatably through the end wall 30, the shaft 60 has a journal portion 62 which is rotatably journalled in bearing means 63 mounted on a crossbeam 64 of the frame structure 31.

Means for driving the shaft 60 rotatably comprise a motor 65 (FIG. 1) connected drivingly to the journal portion 62 of the shaft 60 through a speed reducer 67. For example, where the motor 65 may be of 200 horsepower capacity operating at 1760 rpm, the driven speed of the rotor shaft 60 may be reduced to about 41 rpm to gain maximum chip compression and debarking agitation advantage.

Compression and agitation of the mass of chips within the debarker drum chamber 37 is efficiently effected by means of impeller and agitator vane paddles 68 which are preferably located by alternately staggered radial pairs uniformly spaced along the length of the shaft 60 starting in adjacently spaced relation to the end wall 30 and progressing along the shaft to a final set of 3 vane paddles 69 (FIGS. 3 and 4) located adjacently spaced relative to the end wall 32. In each pair of the paddles 68, they are oriented in diametrically opposite alignment on the shaft 60, and each alternate pair of the paddles 68 is disposed on a diametric axis located 90° offset from the axes of the adjacent pairs of the paddles 68. The set of three end paddles 69 has the paddles located at 120° spacing from one another. All of the paddles 68 and 69 are preferably of the same length and have their distal ends approaching the cylindrical wall of the drum 28 as closely as practicable.

In operation, the paddles 68 and 69 operate like a helical screw or propeller but with portions missing between the sets of paddles. Each of the paddles 68 and 69 is tilted on its axis like a propeller vane so that the combined action of the paddles 68 is to propel the mass of wood chips toward the end wall 32 and compress the chips under heavy pressure, and by virtue of the spacing of the paddles concurrently agitating the mass of chips and causing the chips to rub against one another for dislodging and removing the bark therefrom. In other words, the paddles 68 and 69 operate similarly to a multi-stage compressor to compress the chips into a fairly compact mass, and by the slow speed paddle agitation heavy friction is caused between the chips which effects detachment at the weaker bark from the chips. At the same time, because of the weaker nature of the bark relative to the wood of the chips, the size of the bark particles is reduced to a finely comminuted state which will facilitate subsequent separation of the bark from the chips.

Attainment of optimum debarking results is facilitated by controlling the pressure buildup in the chip mass by controlling the discharge outlet 52 by means of the metering valve 53. Such control is desirable because the properties of the chips can vary widely depending upon the type or species of trees, the age of the chips, seasonal characteristics of the source material trees, and the like. In any given run of chips to be debarked, proper adjustment of the metering valve 53 will assure proper results as can be determined by sampling the debarked chips discharged from the port 52.

Figure 3:
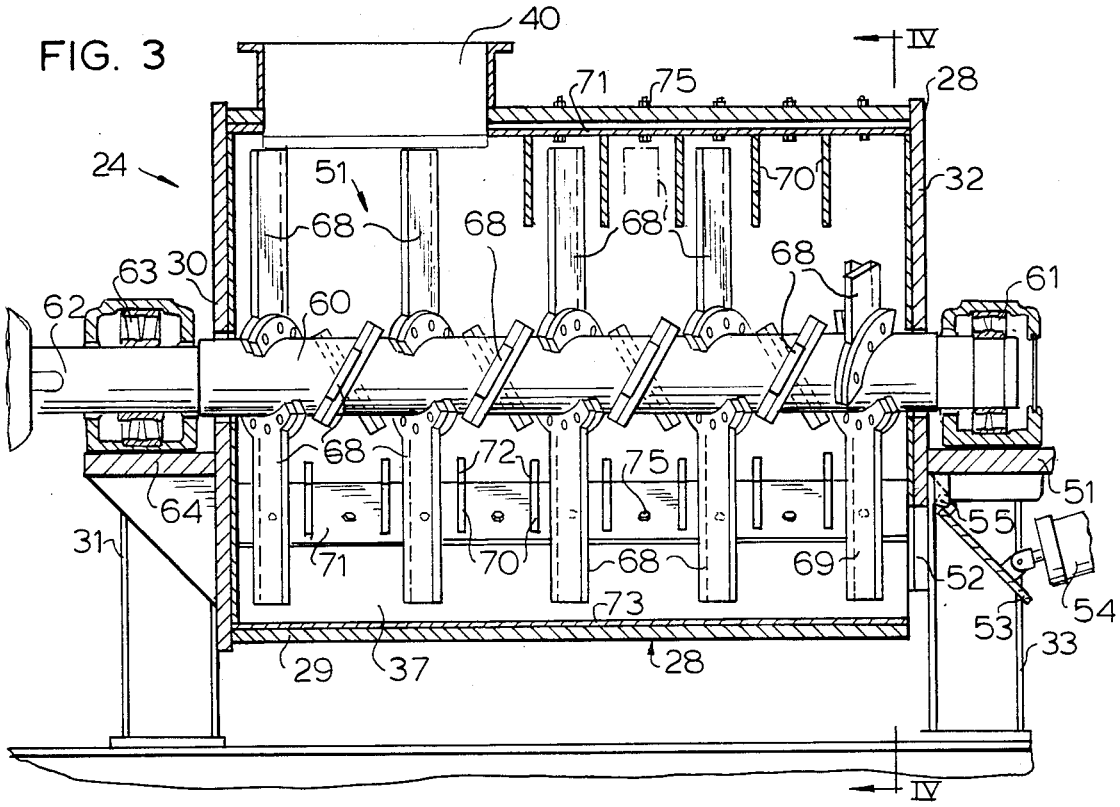
FIG. 3 is a further enlarged, longitudinal sectional detail view taken substantially along the line III—III of FIG. 2.

Cooperatively related to the paddles 68 and 69 and assisting in agitation and preventing plugging of the chipped mass are stationary means carried by the inside of the drum 28 and comprising flat fins 70 (FIGS. 3–5) which are desirably provided in a plurality such as three equally circumferentially spaced longitudinal series mounted on respective mounting bars 71. As best seen in FIG. 3, the fins 70 are located along the mounting bars 71 to project interdigitally into the clearances between the sweep of the respective paddles 68 and 69. The cooperative relation of the fins 70 to the paddles is enhanced by having the inner ends of the fins chamfered as at 72 at the side opposing the sweep direction of the compressing and agitating paddles. For example, where as shown, the sweep of the paddles is counterclockwise, the chamfer edges 72 are biased toward the counterclockwise direction.

Not only do the mounting bars 71 serve as mounts for the fins 70, but in the present instance they also serve as clamping means for a replaceable wear resisting liner for the drum 28. Thus, the liner comprises liner plates 73 which may in part be secured by means of radial flanges 74 clamped between the attachment flanges 34 of the drum sections 29, and in part clamped to the drum sections by means of the mounting bars 71 which are secured in place to the drum sections 29 by means of bolts 75.

Debarked chips and comminuted bark leaving the discharge port 52 drop onto an endless conveyor 77 (FIGS. 1 and 2) and are conveyed to a bark separating screen 78, preferably of the disk screen type, where the detached bark particles are separated from the debarked chips and drop down through a hopper 79 onto a take-away conveyor system 80 which combines the bark with reject fines on the conveyor 21 for eventual use as fuel or other disposition. The debarked chips separated from the loose bark are discharged from the screen 78 through means such as a chute 81 to a chip take-away conveyor 82 for transport to a desired point of accumulation, or chip processing apparatus for converting the chips to paper pulp.

Figure 6:
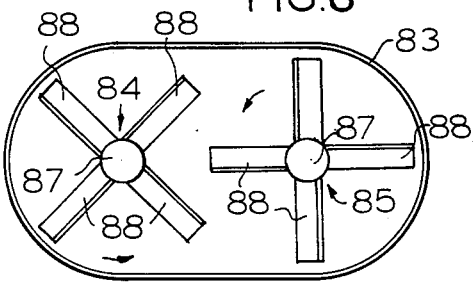
FIG. 6 is a schematic illustration of a modified debarker assembly.
Figure 7:
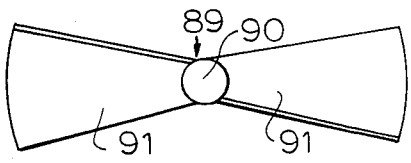
FIG. 7 is an elevational view of a modified compressing and agitating paddle structure.

Although a preferred embodiment of the apparatus has been described, there are various additional or optional construction envisioned for meeting various situations in practicing the present invention. For example, in FIG. 6 is disclosed a debarker drum 83 of larger capacity, such as twice the capacity of the debarker drum 28, and in which a pair of counter rotating rotors 84 and 85 are cooperatively operable. Each of the rotors 84 and 85 comprises a shaft 87 carrying radially extending vane paddles 88 which are angled for propulsion and compacting of a mass of chips in a common direction in the drum 83. Synchronous operation of the chip mass compressing and agitating rotors 84 and 85 may be effected in similar manner as described for the rotor 51. Other features of the debarker assembly represented by the drum 83, and associated chip and removed bark handling system may be substantially the same as already described.

Where increased propulsion and compressing effect in the propeller-like paddles of the debarker rotor is desired, the arrangement shown in FIG. 7 may be employed. Therein rotor 89 has a shaft 90 from which extend radially, propeller-like canted vane paddles 91 which flair to a greater width at their distal ends.

Figure 8:
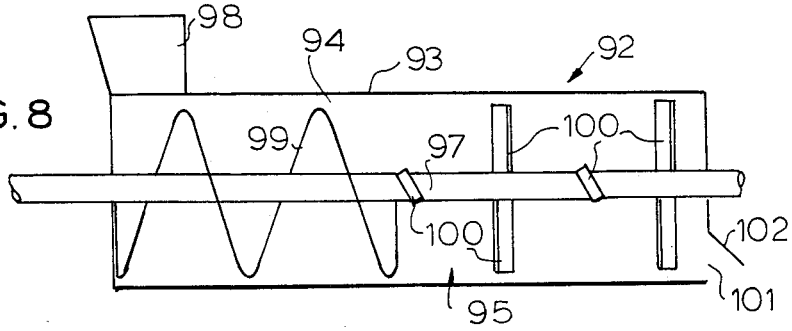
FIG. 8 is a schematic illustration of another modified debarker assembly.
Figure 9:
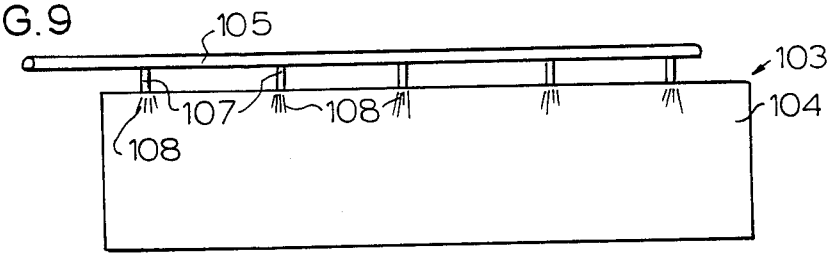
FIG. 9 is a schematic illustration showing optional use of fluid injection or spray means for assisting in the debarking.

In the embodiment shown in FIG. 8, a debarker assembly 92 comprises a drum 93 similar to the drum 28 previously described, but, if desired, of greater length and having mounted within debarking chamber 94 a rotor 95 which has on that portion of its rotor shaft 97 which is nearest feed port means 98 a preloading screw section 99 adapted for precompressing the mass of chips to be debarked toward a debarking section of the rotor equipped with radially extending axially spaced, staggered sets of vane paddles 100. These paddles not only further compress the mass of chips but agitate the same for attaining the desirable chip against chip rubbing, debarking action in accordance with the present invention. Chip mass debarking pressure is adapted to be controlled at a discharge outlet 101 by means of an adjustable metering gate valve 102. Associated structures may be the same as described in respect to FIGS. 1–5.

Where for any reason it may be desired to inject steam of other liquid to enhance the bark removal process, the arrangement shown in FIG. 9 may be employed wherein a debarker assembly 103 which may embody any preferred debarking mechanism within a drum 104, is equipped with means such as one or more manifolds 105 equipped with spaced nozzles 107 for injecting steam or other liquid 108 into the debarker drum 104.

Figure 10:
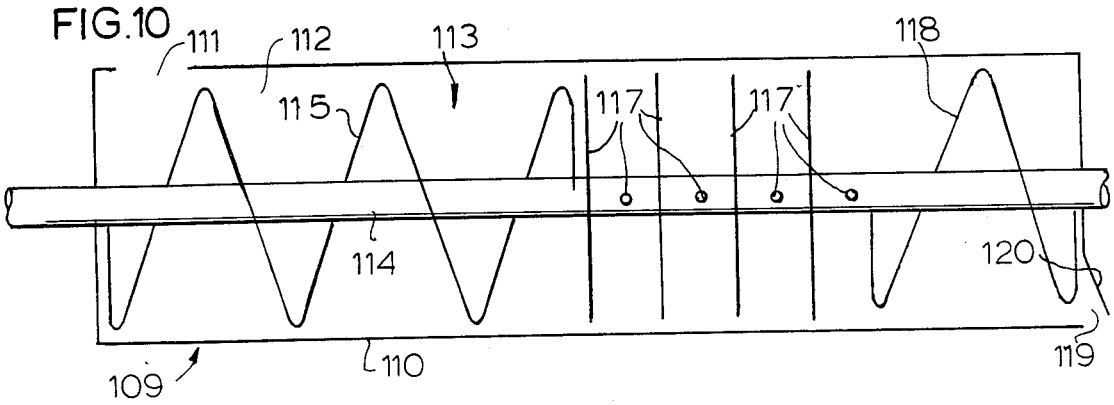
FIG. 10 is a schematic illustration of a further modified debarker assembly embodying the invention.

Another debarker assembly 109 pursuant to the present invention, as shown in FIG. 10, comprises an elongate debarker drum 110 closed at opposite ends and having a feed inlet port 111 adjacent to one end into a debarking chamber 112 within which a debarking rotor 113 is rotatably operative. In this instance, the rotor 113 has on its shaft 114 a helical chip mass compressing screw section 115 which compresses the chips delivered through the port 111 under heavy pressure toward an intermediate stirring section equipped with radially extending vanes or rods 117 by which the compressed mass of chips is agitated for rubbing of chip against chip with debarking action. Downstream within the chamber 113 the shaft 114 carries a discharge control helical screw section 118 controlling discharge of the debarked chips and comminuted bark through a discharge outlet 119 which may be controlled by a metering gate valve 120. This assembly 109 may be substituted for the assembly 24 of FIGS. 1–5.

Figure 11:
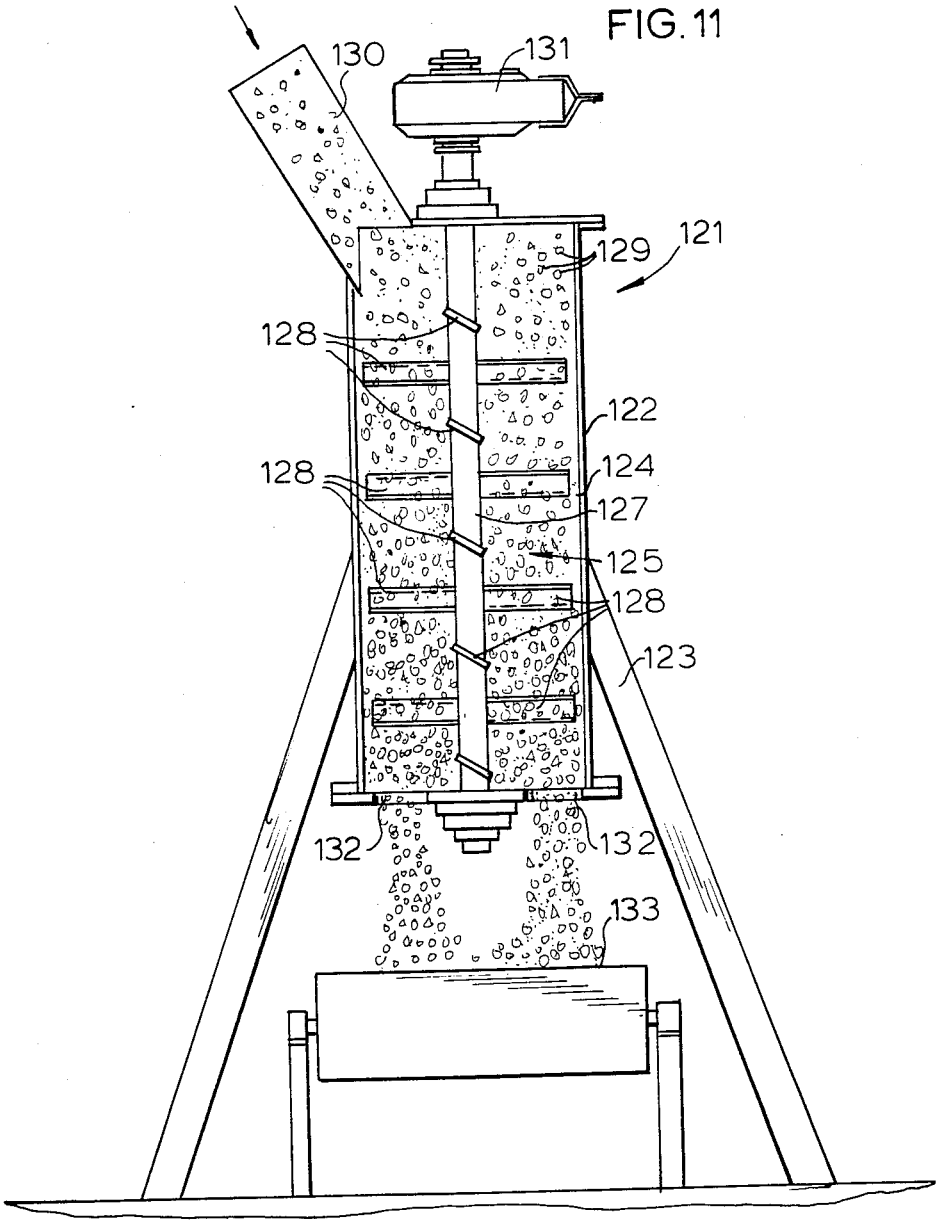
FIG. 11 is a schematic illustration of a vertical debarker assembly embodying the invention.

It may be noted that, if preferred, the rotor 95 of FIG. 8 may be supplied with a stirring section similar to the rotor 113 of FIG. 10 instead of the paddles 100.

Where a vertical debarker 121, as shown in FIG. 11, may be preferred in the system, a vertically extending elongate debarker drum 122 supported by a frame 123 may have a vertical debarking chamber 124 having mounted therein a debarking rotor 125. On a vertical shaft 127 of the rotor 125 are mounted radially extending axially spaced and staggered vane paddles 128 having angularly tilted impellar faces for downwardly impelling and compressing chips 129 to be debarked. The chips 129 are fed into the upper end of the drum through an inlet 130. Means for driving the rotor 125 may comprise a hydraulic motor 131 operatively attached to the upper end of the shaft 127. Chips debarked by the compression and agitation effected through the paddles 128 are discharged from the lower end of the drum 122 through metered discharge openings 132 onto a take-away or forwarding conveyor 133.

It will be understood that variations and modifications may be effected without departing from the spirit and scope of the novel concepts embodied in this invention.

I claim as my invention:

1. A method of debarking wood chips in a container containing no free elements, comprising:

axially compacting a mass of bark carrying wood chips in said container so as to force said mass toward one end of said container;

agitating the compacted mass in said container and causing the chips to rub against one another in the compacted mass;

and thereby removing the bark from the chips by rubbing friction of chip against chip as agitated in the compacted mass and without crushing or otherwise damaging the chips.

2. A method according to claim 1 wherein said container is a debarking drum, and in said drum effecting said compacting, agitating and friction rubbing removal of bark from the chips; and metering the debarked chips and bark removed therefrom through a compacting pressure controlling and metered discharge port from the drum.

3. A method according to claim 2, which comprises effecting said compacting and agitating by rotating a rotor at slow speed within said drum, and driving compacting and agitating paddles of the rotor in the mass of wood chips.

4. A method according to claim 2, which comprises driving a rotor in said drum and effecting said compacting by operating a helical compacting screw in said mass of chips, and effecting said agitating by operating agitating means on said rotor.

5. A method according to claim 4, which comprises controlling discharge of debarked chips and loose bark from said drum by working a helical screw section on a downstream part of said rotor.

6. A method according to claim 1 comprising the additional step of controlling the compacting pressure of said mass by metering discharge of debarked chips from said container.

7. A method according to claim 1, which comprises comminuting the bark removed from the chips by pressure and friction applied to the bark by the agitated chips in said mass.

8. A method according to claim 1, which comprises injecting bark removal enhancing fluid into the mass of chips undergoing compacting and agitating.

9. A method of debarking wood chips in a container containing no free elements, comprising:

supplying bark carrying wood chips to be debarked;

classifying the supplied wood chips by removing fines and oversize chips from chips of desirable size;

axially compacting the chips of desirable size into a mass of the wood chips in said container so as to force said mass toward one end of said container;

agitating the compacted mass in said container and causing the chips to rub against one another in the compacted mass and without crushing or otherwise damaging the chips;

thereby removing the bark from the chips by rubbing friction of chip against chip as agitated in the compacted mass;

and separating the removed bark from the thus debarked chips.

10. A method according to claim 9, which comprises during said classifying separating oversize wood chips from the desirable size chips, rechipping the oversize chips, and recycling the rechipped chips through the classifying step.

11. Apparatus for debarking wood chips, comprising:

a container including means for axially compacting a mass of bark carrying wood chips with substantial compacting pressure at one end of said container, and for slowly agitating the compacted mass in said container and causing the chips to rub against one another in the compacted mass without crushing or otherwise damaging the chips, said container having no free elements therein;

so that the bark is removed from the chips by rubbing friction of chip against chip as agitated in the compacted mass and clean undamaged chips are derived.

12. Apparatus according to claim 11 wherein said container is a debarking drum, and further comprising means for controlling compact pressure and metering the debarked chips and bark removed therefrom through a metered discharge port from the drum.

13. Apparatus according to claim 12, wherein said means for compacting and for agitating comprises a rotor within said drum, said rotor having compacting and agitating paddles operating in the mass of wood chips in the drum.

14. Apparatus according to claim 12, comprising a rotor in said drum providing a helical compacting screw for compacting said mass of chips, and said rotor having agitating means thereon operative in the mass of chips as compacted by said helical compacting screw.

15. Apparatus according to claim 14, wherein said rotor has a helical screw section thereon downstream from said agitating means and adapted to control discharge of debarked chips and loose bark from said drum.

16. Apparatus according to claim 11, including means for injecting bark removal enhancing fluid into the mass of chips undergoing compacting and agitating.

17. Apparatus according to claim 11 wherein said container is an elongate debarking drum having a debarking chamber therein, and further comprising a rotor rotatably mounted within said chamber and having said means for axially compacting and for agitating mounted thereon, means for rotatably driving said rotor, means for loading wood chips to be debarked into an end of said chamber opposite said one end, and compacting pressure controlling and metering discharge means at said one end.

18. Apparatus according to claim 17, wherein said metering discharge means comprises a discharge port, and metering valve means in control of said port and adapted for controlling the pressure with which said rotor means compacts the mass of wood chips.

19. Apparatus according to claim 17, wherein said drum and said rotor are mounted on a vertical axis, said feeding means and said rotor driving means being located at the upper end of said drum, and said metering discharge means being located at the lower end of said drum.

20. Apparatus according to claim 11 wherein said container is a debarking drum within which said mass of wood chips is received, and further comprising a rotor operating rotatably in said drum, said means for axially compacting and agitating comprising radially extending paddles on said rotor, and fixed agitation enhancing fins projecting from said drum in interdigital relation to said paddles.

21. Apparatus according to claim 11, comprising a drum defining a debarking chamber, and said means for compacting and agitating comprising a pair of cooperatively related parallel axes rotor devices operating in said chamber.

* * * * *